United States Patent [19]

Koffler

[11] Patent Number: 4,730,361

[45] Date of Patent: Mar. 15, 1988

[54] HAIRBRUSH CONSTRUCTED AND ARRANGED TO LIFT AND SHAPE HAIR

[76] Inventor: Henry Koffler, 8956 NW. 9th Pl., Plantation, Fla. 33324

[21] Appl. No.: 887,216

[22] Filed: Jul. 21, 1986

[51] Int. Cl.[4] ..... A46B 9/02

[52] U.S. Cl. ..... 15/160; 15/159 A; 15/186; 15/DIG. 5; 132/85; 132/120; D4/134

[58] Field of Search ..... 15/159 R, 159 A, 160, 15/186–188, DIG. 5; 132/85, 120, 121, 126, 141, 142; D4/130–137

[56] References Cited

U.S. PATENT DOCUMENTS

| | | | |
|---|---|---|---|
| D. 134,720 | 1/1943 | Herschensohn . | |
| 792,013 | 6/1905 | Flemming | 132/120 |
| 1,950,667 | 3/1934 | Fulton | 132/142 |
| 2,633,591 | 4/1953 | Servilla | 132/120 X |
| 4,121,314 | 10/1978 | Nathe | 15/203 |
| 4,417,595 | 11/1983 | Okumura et al. | 132/85 |

FOREIGN PATENT DOCUMENTS

| | | | |
|---|---|---|---|
| 252769 | 4/1927 | Italy | 15/159 R |
| 463292 | 4/1951 | Italy | 132/142 |
| 225048 | 11/1924 | United Kingdom . | |

*Primary Examiner*—Peter Feldman

*Attorney, Agent, or Firm*—Robert M. Schwartz; Edward I. Mates

[57] ABSTRACT

This invention relates to a hairbrush that comprises bristles or bunches of bristles arranged in parallel rows. The length of the bristles in each row differs from row to row in the direction in which the brush is moved through the hair of a person whose hair is being brushed so as to have the row of longest bristles lift or fluff each successive increment of hair it engages and have the successive rows of successively shorter bristles smooth down each successive increment of hair that has been lifted by the longer bristles in the previous rows that engage the hair.

6 Claims, 6 Drawing Figures

HAIRBRUSH CONSTRUCTED AND ARRANGED TO LIFT AND SHAPE HAIR

BACKGROUND OF THE INVENTION

I. Field of the Invention

This invention relates to a new and improved hairbrush constructed and arranged to minimize tangling and snarling and to lift and shape hair to each individual head.

II. Technological Problems and Prior Art

It is common knowledge today that a hairbrush comprising bristles whose outer ends terminate in a flat common plane has less hairbrushing effect than bristles whose ends form certain other configurations because a flat configuration of bristle ends is an inefficient way to penetrate into the body of hair growing from a head that has a curved shape from front to rear. It is necessary to first separate and lift the strands incrementally and then smooth the lifted strands as the brush moves across a person's head. In case all the bristles are stiff enough and long enough to penetrate completely to the scalp, they may cause damage to the skin of the head of the person whose hair is being brushed while lifting the strands. Also, long stiff bristles are not capable of smoothing the lifted strands. If the bristles are not long enough and/or stiff enough to penetrate into the depth of the hair, they fail to separate the strands, and the unbrushed hair strands near the scalp remain snarled and/or tangled. The aforesaid problems apply equally when bristles are mounted individually or when bristles extend in bunches from a base of a brush.

Some prior art developments in hairbrushes have provided bristles of different lengths. However, some of these prior art arrangements of bristles have been defective because longer bristles of low stiffness tend to buckle before reaching the hair root while shorter bristles of the same stiffness tangle with the hair. When stiffer bristles are used, even shorter stiffer bristles scrub the skin of the head of a person whose hair is being brushed and thus cause damage to the head skin. Other alleged improvements involve the combination of hair bristles of different materials, different lengths and/or different stiffness intermixed to provide different bristles with different characteristics, some of which penetrate the complete depth of the hair and others of which penetrate only a portion of the depth of hair. However, manufacturing hairbrushes having intermixed bristles of different physical structures or different materials represents a complicated inventory problem in the fabrication of hairbrushes.

The following patents disclose some interesting features that have been developed in hairbrushes prior to the present invention. As will be explained later, these developments still leave room for additional improvement in the hair brushing art.

U.S. Pat. No. 651,841 to Flemming discloses a method of manufacturing brushes with curved backs. In this patent, methods are provided for producing brushes whose free ends define any desired curved configuration such as brushes of serpentine, spherical, ellipsodial, cylindrical, or other curved form. In all of the embodiments of this patent, all of the bristles are of equal length extending from the base of the brush. Therefore, all of the brush bristles have the same penetrating effect into the depth of hair being brushed. Therefore, when the brushes produced by the method of this patent move across a person's head, all of the bristles either penetrate to the scalp to scratch the latter or fail to penetrate to a hair depth sufficient to avoid snarling or tangling. Hence, brushes produced by the Flemming method are incapable of performing the function of the brushes of the present invention that will be described in greater detail later.

U.S. Pat. No. 1,259,571 to Wiens discloses a shaving brush having soft bristles. The ends of the soft bristles, when straight, form an arcuate, convexly shaped, discontinuous surface in any cross-section of the brush. Such a brush structure may be suitable for applying shaving cream onto the face of a person desiring to shave. However, the brush resulting from the method of this invention is incapable of brushing hair on the scalp of an individual.

U.S. Pat. No. 1,393,635 to Mondy discloses an electric hairbrush whose bristles are of uniform length extending from a brush base that is curved convexly both in the direction of the length of the brush handle and transverse to the brush handle. Each of the bristles of such a brush is capable of entering the depth of hair that equals the depth of hair penetrated by every other bristle. Hence, all the bristles of the Mondy brush are either stiff enough to penetrate the hair to the scalp to scratch the latter during hairbrushing, or are soft enough to fail to penetrate into the lower depths of the hair so that the hair remains at least partly snarled and/or tangled after brushing.

U.S. Pat. No. 1,963,389 to Vardeman discloses an arrangement of bristles for a toothbrush. In this patent, the outer ends of the bristles form a concave discontinuous surface in the direction of the length of the toothbrush handle. While such a toothbrush is designed to provide ready penetration between adjacent teeth for the efficient cleaning of all cracks and crevices, such a toothbrush would not be suitable for brushing hair on the scalp of a human being.

U.S. Pat. No. 3,047,898 to Levite discloses a multi-use hairbrush provided with four different types of bristle ranging from fine flexible smoothing bristles on one side to coarse stiff combing bristles on the other side. In this hairbrush, two adjacent rows of bristles of each type extend parallel to one another along the length of the brush in the direction of the brush handle and gradually change in stiffness from pair to pair from said flexible smoothing bristles along one side edge of the brush to said stiff combing bristles along the other side edge of the brush. The necessity for fabricating a hairbrush having four different types of bristles renders the fabrication process awkward to say the least, because of the need to maintain an inventory of four different types of bristles.

U.S. Pat. No. 3,180,342 to Dietsch discloses a brush-comb. In this patented utensil, rows of bristles having the characteristics of brush bristles alternate with rows of teeth having the characteristics of teeth in a comb. The rows extend in the direction of the length of the handle of the utensil. The length of the bristles or teeth gradually decrease from a maximum length at a maximum distance from the utensil handle to a minimum length at the end of the utensil adjacent its handle. Brush-combs of this type are used particularly for grooming permanent wave coiffures, and are not suitable for the type of hairbrushing at which the present invention excels, as will be explained later.

U.S. Pat. No. 4,014,064 to Okazaki discloses a hairbrush comprising a plurality of tufts of bristles evenly and orderly distributed over the face portion of the brush. Each tuft consists of bristles of three different lengths. The bristles are divided into three rows in a manner such that the longest bristles account for the largest numerical portion of each tuft of bristles and the smaller sizes are of a correspondingly lesser amount in accordance with a predetermined proportion. The tufts extend obliquely from the base of the brush so that three oblique, parallel rows of tufts on one side of the longitudinal axis of the brush diverge from three oblique, parallel rows on the other side of the longitudinal axis of the brush. The ends of each length of bristle in each tuft lie in one or another of three flat, discontinuous planes so that when the brush moves across a person's head, each increment of hair is subjected to six intermittent brushings by six lines of tufts, each tuft having three bristles of different length.

In spite of the many variations in design and construction and arrangement of brush bristles as evidenced by the prior art patents just described, the prior art still lacked a hairbrush that provided suitable lifting of the entire thickness of the hair to fluff the hair combined with an ability to smooth the hair at the end of the brushing stroke.

BRIEF DESCRIPTION OF THIS INVENTION

This invention provides a hairbrush containing either individual bristles or bunches of bristles constructed and arranged to minimize tangling or snarling during the hairbrushing operation and to lift and shape hair to each individual head. This invention arranges bristles of uniform thickness but of different lengths in a special manner devised by the teachings of the present invention to avoid tangling or snarling and still obtain a smooth fluffing of the hair that shows the layers of hair in a better light than hairbrushes of the prior art.

Brushes containing bristles of uniform thickness are easy to fabricate. Since all bristles have the same thickness, inventory problems are minimized. Elongated strands of bristle material of a uniform thickness can be kept in inventory and cut to suitable lengths when such lengths are needed for production.

The benefits of the present invention will be better understood in the light of a description of several preferred embodiments that follow.

DESCRIPTION OF THE DRAWINGS

In the drawings that form part of a description of a preferred embodiment of the present invention and variations thereof.

DESCRIPTION OF PREFERRED EMBODIMENTS

Figure 1:
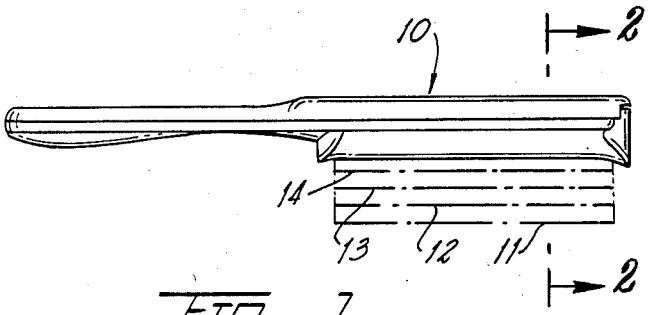
FIG. 1 is a longitudinal side view of a hairbrush conforming to this invention, with the bristle arrangement shown in phantom.
Figure 2:
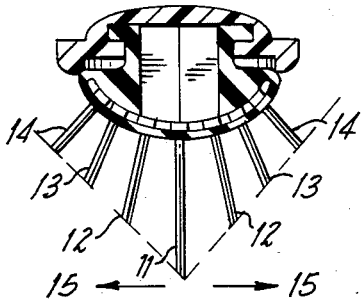
FIG. 2 is a cross-sectional view of a universal embodiment of the present invention taken along line II—II of FIG. 1.

Referring to the drawings, and particularly to FIGS. 1 and 2, a first embodiment of the present invention is disclosed for universal use by left-handed and right-handed people. The brush of uniformly spaced, longitudinally extending rows of bristles mounted to extend outwardly from a base 10. The latter is connected to and in line with an elongated handle. The view in FIG. 2 is a cross-section of the base showing a centrally disposed bristle 11 from a longitudinally extending row of bristles 11 extending outwardly from the base a maximum distance, flanked by slightly shorter bristles 12 in laterally adjacent flanking rows. The latter are flanked outwardly by rows of additional bristles 13 slightly shorter than bristles 12. An outermost row of shortest bristles 14 is arranged in laterally spaced relation outwardly of each row containing bristles 13.

In a typical embodiment of this invention, bristles 11 are three-fourths of an inch long, bristles 12 are five-eighths inch long, bristles 13 are one-half inch long and bristles 14 are three-eighths inch long. All of the bristles in each row are of the same length along its associated row. The bristles are all of the same thickness and may be provided with tips (not shown) at their free ends and may be enlarged at their bottom ends to fit in apertures through the roof of the base portion 10 to support the bristles that extend outwardly from base 10. The bristles may be of different hardness depending on type of hair if coarse, normal and thin hair.

When a person brushes his hair, one moves the brush across his head transverse to the length of the parallel rows of bristles to first engage the row containing the longest bristles 11, which penetrate the hair to a maximum depth, to a first increment of hair transverse to the direction of brush movement. Regardless of whether the hairbrush is moved to the left or to the right, as the row containing the longest bristles 11 moves across the head of the person whose hair is being brushed, the first increment of hair is then engaged or penetrated by the row containing bristles 12 adjacent the row containing bristles 11. Since the bristles along the second row that then engage the hair are shorter than the bristles 11 in the first engaging row, they do not penetrate as deeply as the bristles 11 in the first row to engage the hair. As the brushing stroke continues, a row of bristles 13 shorter than the bristles 12 engages the hair while the bristles in rows 11 and 12 are simultaneously engaging different portions of the hair. Finally, the end row 14 of shortest bristles also enters the thickness of the hair and penetrates to a lesser depth than the bristles of the previous row containing the next longer line of bristles 13, which, in turn penetrate to a lesser depth than the next line of slightly longer bristles 12, which in turn penetrate to a lesser depth than the longest bristles 11. As the stroke of brushing continues, each increment of hair transverse to the direction of brush movement 15 is similarly treated. Finally, the row of longest bristles 11 leaves the thickness of the hair and successively, the row of shorter bristles 12 subsequently leave the hair followed by the next row of shorter bristles 13 until finally the shortest bristles 14 of the row of shortest bristles leave the hair of the person whose hair is being brushed at the end of the brushing stroke.

Each successive increment of hair that is brushed has its strands initially lifted and separated by the longest bristles 11. As the progressively shorter bristles 12, 13 and 14 engage the increment of hair to be brushed, they shape and smooth the strands of hair that were lifted and separated by the row of longest bristles 11. Finally, the end row of shortest bristles 14 sequentially smoothes the strands of each increment of hair to provide a desired coiffeur.

Initially, the hair is brushed while wet. Wet or dry, the present brush works better than prior art brushes to provide the shaping and smoothing by virtue of the operation of the successively shorter lengths of bristles in the successive rows that engage each increment of hair to lift and separate the strands initially, and finally, to pat down and smooth the hair increment by increment.

Figure 3:
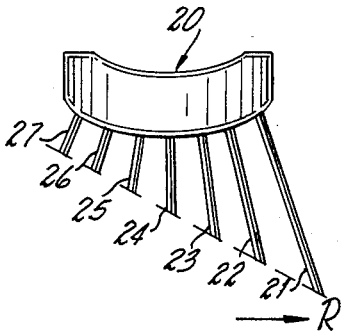
FIG. 3 is a view similar to that of FIG. 1 of a second embodiment of the present invention suitable for use by a person who brushes his hair with his right hand.
Figure 4:
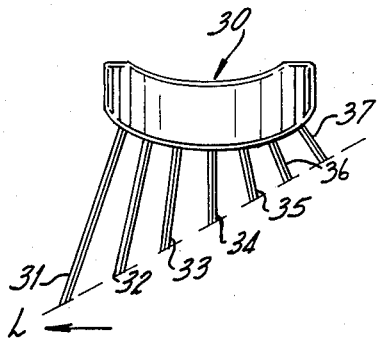
FIG. 4 is a view similar to those of FIGS. 2 and 3 showing the cross-section of a third embodiment of brush suitable for use by a person who brushes his hair using his left hand.

FIGS. 3 and 4 show alternate embodiments of the present invention suitable for brushing by right-handed and left-handed people, respectively. In the embodiment of FIG. 3, a brush base 20 is shown supporting seven parallel, equally spaced rows of bristles 21 through 27. These bristles extend outwardly from the base of the brush by lengths that are progressively shorter from row to row from the right side of the brush containing bristles 21 through successive parallel rows of successively shorter bristles 22, 23, 24, 25, 26 and 27. If the brush is held so that the bristles extend downward, a right-handed person would move the brush in the direction of the arrow R so as to cause an end row of longest bristles 21 to engage increments of hair from left to right first, followed by successive engagements with rows of bristles of successively shorter lengths to provide the desired result obtained from using only the center row of bristles and those to the left side thereof in the embodiment of FIG. 2.

Similarly, a brush having a base 30 and rows of bristles 31 to 37 arranged for a left-handed person, is shown in FIG. 4. The row of longest bristles 31 is located at the left side of the brush and successive rows of successively shorter bristles 32, 33, 34, 35, 36 and 37 (each one to the right of the preceding row) engage each increment of hair across a person's head in succesion as a left-handed person brushes the hair using this embodiment, moving the brush in the direction of arrow L.

In a typical embodiment of right or left-handed brush, the longest bristles 21 and 31 in the row along the longidudinal side of the brush closer to the hand used by the person brushing are three-fourths inch in length and each successive row of bristles extends one-eighth inch less from the respectively base 20 or 30 until the shortest bristles 27 and 37 along the row opposite the first row of brushes extend one-fourth inch. It is understood that these figures are only for illustrative purposes to depict a presently preferred embodiment and that modifications in the length of bristles so that the difference in length of bristles between adjacent rows of bristles need not be uniform and the number of rows of bristles may be modified or the spaces between adjacent rows may not be exactly the same without departing from the gist of the present invention.

Figure 5:
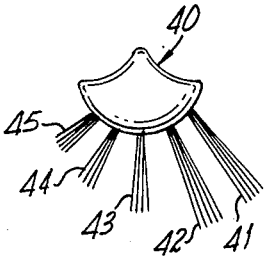
FIG. 5 is a view of an alternate embodiment of a hairbrush similar to that of FIG. 3 wherein the bristles are arranged in bunches.

FIG. 5 shows an additional embodiment of the present invention provided with a relatively narrow base 40 which supports five rows of bristles in bunches. The bristles in bunch 41 are the longest and extend in a row adjacent one side of the brush. Adjacent thereto is a second row containing bunches of bristles 42, having a length less than those of bristles in bunches 41. The next row of bristle bunches has bristles 43 of intermediate length. Continuing in the same direction, bristles 44 in the fourth row of bristles have a length less than that of bristles 43. The bunches of bristles 45 extending in a row adjacent the opposite longitudinal side edge of the base 40 have the shortest length of all of the bristles in the brush of FIG. 5.

This embodiment of FIG. 5 also shows another feature common to that of FIGS. 1 to 4 in the arrangement of the bristle bunches that may also be provided for bristles arranged in rows of individual bristles. Each individual longitudinally extending row includes bristles that extend in a plane that diverges from the planes defined by the length of bristles in adjacent rows. In the preferred embodiments of this invention, the angles of divergence between bristles of adjacent rows is essentially uniform. Thus, in the best embodiment of this invention, the longitudinally extending rows of bristles or bunches are equally spaced from one another, their individual bristles extend in planes that diverge at equal angles from the planes in which the bristles of adjacent rows extend and the length of bristles of adjacent rows are preferably identical along each row and differ by uniform changes in length between adjacent rows.

The exactness of the conformance of the bristle lengths and orientations in different rows of bristles to the criteria enumerated in the previous paragraph results in superior performance brushes. The latter first engage the hair at a maximum depth, first with the row of longest bristles, followed in sequence by rows of bristles of successively shorter lengths spaced at equal spaces and diverging from adjacent bristle rows at uniform angles of divergence from row to row, to provide a brushing action that diminishes in uniform steps from row to row. Optimum results exist when the handle of the brush is turned about its longitudinal axis as is customary in hair brushing. While some deviation in non-uniformity of differences in bristle penetration from row to row resulting from any variation from uniformity of these criteria would reduce the efficiency of brushing, some slight variations from such uniformity can be tolerated as the brush need not conform to a perfect embodiment to represent an improvement over the prior art.

It is understood that the arrangement of the bristles can be made in a mirror image, such as, the manner by which FIG. 4 differs from FIG. 3 to provide a left-handed bristle arrangement in bristle bunches. In addition, bristle bunches arranged as depicted in the variation of lengths between adjacent rows of FIG. 2 can be arranged in bunches rather than in rows of individual bristles as depicted in FIG. 2 without departing from the spirit of the present invention. Furthermore, the difference in length of bristles constituting bunches occupying adjacent rows need not differ in length by exactly the same distance from row to row.

One significant feature of this invention is that all the bristles used in any one brush are of uniform thickness, except for the portion that is used to attach the coupled end of the bristle to the base 10, 20, 30 or 40 and the presence, if desired, of a tip of soft material at the outer end of the individual bristles that are arranged in rows either as individual bristles or grouped in bunches of bristles. Bristles so tipped do not harm the scalp of an individual whose hair is being brushed as readily as untipped bristles.

The brushes shown must be oriented with their bristles or bristle bunches facing downward in the operative position. The embodiment of FIG. 2 shows the ends of the bristles lying in two oblique flat planes that intersect along the row that contains longest bristles 11. The ends of the bristles in a set of at least three consecutive rows lie in one flat oblique plane and the ends of the bristles of another set of at least three consecutive rows lie in another flat oblique plane that intersects said one flat oblique plane. The other embodiments show the ends of rows of bristles 21 to 27 lying in flat oblique planes. These flat planes for the free ends of the individual bristles or bristle bunches is preferred, because the flat planes defined by the bristle ends results from uniform row spacing, uniform divergence between adjacent rows and uniform difference in length from row to row. However, the planes defined by the bristle ends depart from flatness when any of the criteria of bristle length uniformity along any row, uniformity of difference in bristle length from row to adjacent row, and uniform angle of divergence between adjacent pairs of rows departs from uniformity to produce brushes that are only slightly less efficient than the best embodiment, yet are still superior to the prior art.

In all of the embodiments illustrated in FIGS. 1 to 5, the bristles of each row have a length that is uniform for that row so that the bristle ends define lines that are straight for each row. Since the human scalp is rounded convexly from front to rear, it would appear that having bristles vary in length along the length of each row would provide a better brushing action than brushes provided with rows of bristles whose ends occupy positions along a straight line unique for each row. However, each skull has a unique shape from front to rear and this shape differs from side to side of the scalp, so that this feature can be obtained only by performing an expensive, time-consuming operation of measuring each individual skull, arranging bristles of a great variety of lengths for assembly and assembling each brush on an individual basis.

Figure 6:
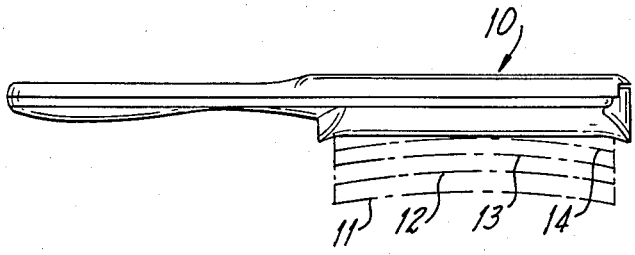
FIG. 6 is a view similar to that of FIG. 1 of an additional embodiment of this invention.

Inventory problems multiply when the rows of bristles have lengths that vary along the length of each row so that the lines interconnecting the ends of the bristle in each longitudinal row is curved to an average curvature from front to rear of human beings. Nevertheless, the present invention encompasses rows of bristles whose ends lie in curved lines as well as in straight lines. However, as a practical matter, the cost of manufacturing brushes whose bristles end along curved lines rather than straight lines for each longitudinal row is too great to make the first named process practical for mass production purposes. Furthermore, sufficiently good results are obtained with brushes whose ends lie in straight lines to make further expense extravagent. However, such an embodiment as depicted in FIG. 6 is not precluded from the gist of this invention.

All of the bristles in all of the rows of all the embodiments previously described and shown in FIGS. 1 to 6 of the drawings have the same thickness in any given brush. However, it is within the concept of this invention to provide bristles or bunches of bristles in brushes for people who have relatively thick, wiry hair with relatively thick bristles that are stiff enough to lift and separate tresses of relatively thick, wiry hair and to provide bristles or bunches of bristles for people who have relatively thin and/or sparse hair with relatively thin bristles sufficiently stiff to brush relatively thin and/or sparse hair, yet with less stiffness than the bristles needed in brushes for people with relatively thick, wiry hair. The same modification to have bristles of different thicknesses for people with different types of hair may also be made with hairbrushes whose bristles are arranged in bunches.

In conformance with the provisions of the patent statutes, the principle, preferred construction and mode of operation of the present invention has been explained and illustrated and what are presently considered to represent the best embodiments have been described. However, it should be understood that within the scope of the claimed subject matter that follows, the present invention may be practiced otherwise than as specifically illustrated and described.

What is claimed is:

1. A hairbrush comprising an arcuately curved base portion supporting hair grooming means consisting essentially of bristles constructed and arranged in a plurality of generally parallel, longitudinally extending, transversely spaced rows in such a manner that the ends of said bristles of a set of at least three of said consecutive rows lie in one flat oblique plane and the ends of said bristles of another set of at least three of said consecutive rows lie in another flat oblique plane that intersects said one flat oblique plane, wherein said rows include a row containing bristles of shortest length at each side of said base flanked by rows of bristles of increasing length from row to row toward a row of longest bristles at the longitudinal center line of said base, all of said bristles lying in one or another of said two flat oblique planes.

2. A hairbrush as in claim 1, wherein said bristles are arranged in bunches.

3. A hairbrush as in claim 1, wherein all of said bristles have the same thickness.

4. A hairbrush comprising an arcuately curved based portion supporting hair grooming means consisting essentially of bristles constructed and arranged in a plurality of longitudinally extending, transversely spaced rows having essentially uniform spacing between adjacent of said rows, the bristles increasing in length from row to row by a uniform difference in length from each side of said base toward the longitudinal center line of said base to enable the ends of said bristles in sets of at least three consecutive rows on either side of said longitudinal center line to lie in one or another of two flat oblique planes that intersect with one another, wherein the bristles in each of said rows have a unique orientation that diverges from adjacent bristle rows by uniform angles of divergence from row to row.

5. A hairbrush as in claim 3, wherein said bristles are arranged in bunches.

6. A hairbrush as in claim 4, wherein the bristles increase in length toward a single row at the longitudinal center line of said base.

* * * * *